US007923388B2

(12) United States Patent
Ludemann et al.

(10) Patent No.: US 7,923,388 B2
(45) Date of Patent: Apr. 12, 2011

(54) OLEOPHOBIC POLYOLEFIN FIBER MATERIALS

(75) Inventors: Simpert Ludemann, Bobingen (DE); Rule Niederstadt, Augsburg (DE); Jurgen Riedmann, Augsburg (DE); Daniel Wilson, Langweid a. Lech (DE)

(73) Assignee: Huntsman Textile Effects (Germany) GmbH, The Woodlands, TX (US)

( * ) Notice: Subject to any disclaimer, the term of this patent is extended or adjusted under 35 U.S.C. 154(b) by 0 days.

(21) Appl. No.: 12/301,717

(22) PCT Filed: May 9, 2007

(86) PCT No.: PCT/EP2007/004079

§ 371 (c)(1), (2), (4) Date: Nov. 20, 2008

(87) PCT Pub. No.: WO2007/134715

PCT Pub. Date: Nov. 29, 2007

(65) Prior Publication Data

US 2009/0264037 A1 Oct. 22, 2009

(30) Foreign Application Priority Data

May 23, 2006 (EP) ..... 06010600

(51) Int. Cl.
*B32B 27/04* (2006.01)

(52) U.S. Cl. ..... 442/91; 427/569

(58) Field of Classification Search ..... 442/91, 442/164

See application file for complete search history.

(56) References Cited

U.S. PATENT DOCUMENTS

| | | | | |
|---|---|---|---|---|
| 3,968,066 | A | 7/1976 | Mueller | |
| 4,054,592 | A | 10/1977 | Dear et al. | |
| 4,696,830 | A * | 9/1987 | Obayashi et al. | 427/491 |
| 4,898,981 | A | 2/1990 | Falk et al. | |
| 2002/0192385 | A1 | 12/2002 | Jenkner et al. | |
| 2004/0075074 | A1 | 4/2004 | Kubota et al. | |
| 2004/0147665 | A1 | 7/2004 | Yoshioka et al. | |
| 2007/0190874 | A1 * | 8/2007 | Vazquez | 442/81 |

FOREIGN PATENT DOCUMENTS

| | | | |
|---|---|---|---|
| EP | 1221347 | A | 7/2002 |
| JP | 20040156163 | | 6/2004 |
| WO | WO 2005/103362 | A | 11/2005 |

* cited by examiner

*Primary Examiner* — Lynda Salvatore

(57) ABSTRACT

Polyolefin fiber fabrics can be endowed with oil-repellent properties by treating them first in a plasma atmosphere to raise their surface tension, then with a polyorganosiloxane containing polyoxyalkylene groups and finally with a polyacrylate or polyurethane containing perfluoroalkyl radicals. The fabrics thus obtained are useful for medical as well as other applications.

5 Claims, No Drawings

OLEOPHOBIC POLYOLEFIN FIBER MATERIALS

CROSS REFERENCE TO RELATED APPLICATIONS

This application is the National Phase of International Application PCT/EP2007/004079 filed May 9, 2007 which designated the U.S. and which claims priority to European Patent Application (EP) 06010600 filed May 23, 2006. The noted applications are incorporated herein by reference.

This invention relates to polyolefin fiber materials specially treated to have oleophobic properties.

Polyolefin fibers such as polyethylene or polypropylene fibers in particular are very apolar materials, i.e., do not have any oil-repellent properties. However, there are certain applications for these fibers where oleophobic properties are desired or required. One instance of such applications is the use of textile fabrics of these fibers in the medical sector; the articles in question include surgical drapes or apparel items for operating room personnel, where good oil and soil repellency is required as well as good water/alcohol repellency. In addition, fiber materials composed of polyolefin fibers are readily available and inexpensive to manufacture and so are superior to many other fiber materials in the sector of cheap, disposable articles.

JP-A 2004/156 163 discloses polyolefin fiber materials having hydrophilic properties due to a treatment with polysiloxanes. These materials do not have oil-repellent properties.

It is an object of the present invention to provide textile fabrics of 90-100% by weight of polyolefin fibers that have oil-repellent or oleophobic properties.

We have found that this object is achieved by polyolefin fiber fabrics obtainable by the following steps a) to c) of a) treating a textile fabric consisting of polyolefin fiber to an extent in the range from 90% to 100% by weight and preferably to an extent of 100% by weight, in a plasma under such conditions that, after step a) has been carried out, the fabric has a surface tension in the range from 35 to 60 mN/m, b) treating the fabric obtained after step a) with a polyorganosiloxane containing $R_3Si—O—$ units as end groups and, within the polyorganosiloxane chain, units of the formula (I)

$$—Si(R)_2—O— \quad (I)$$

and units of the formula (II)

$$—Si(R)(X)—O— \quad (II)$$

where each R is independently $CH_3$, $CH_2—CH_3$ or phenyl, and each X is a radical of the formula (III)

$$—(CH_2)_t(O—CHR^1—CHR^2)_z—OR^3 \quad (III)$$

where t is from 1 to 4, z is from 5 to 60, in each unit of the formula $$—O—CHR^1—CHR^2—$$

one of $R^1$ and $R^2$ is H and the other is H or $CH_3$ and every $R^3$ present is H or is R, c) treating the fabric with a polymer containing perfluoroalkyl (RF) groups, this polymer being a polyacrylic polymer having RF groups or a polyurethane having RF groups or a mixture of such polymers, this step c) being carried out concurrently with step b) or later than step b).

Fabric weight and process conditions may be adjusted to produce articles having very good oil-repellent or oleophobic properties on one surface only or on both surfaces.

The process provides textile polyolefin fiber fabrics having remarkably good oleophobic, i.e., oil-repellent, properties. It has emerged that all the 3 steps a), b) and c) are necessary if optimal oleophobic properties are to be achieved for the fiber materials. This is because treating the fabrics only with polysiloxane and/or with polymers having perfluoroalkyl groups (RF) in accordance with step b) and/or c) but without prior plasma treatment in accordance with step a), results in an insufficient level of oil repellency. Oil-repellent or oleophobic properties can be determined by the test methods more particularly described hereinbelow. If, on the other hand, the polyolefin fiber materials are only treated with plasma and with polyorganosiloxane in accordance with steps a) and b) but without treatment with RF polymers in accordance with step c), no oil-repellent properties result. If, furthermore, step b) is omitted, a certain degree of oleophobicity is obtained on the fiber material after plasma treatment (step a)) and treatment with RF polymers (step c)), but that level is insufficient for a whole series of applications. It is only when step b) is additionally carried out that an excellent level is achieved for the oil-repellent properties. This is particularly surprising and unexpected because those skilled in the art know that, normally, the oil-repellent properties achievable by means of fluoropolymers on textiles, an example being home textiles made of cotton, are lost again on trying to additionally treat the cotton articles with polysiloxanes in order that a pleasantly soft hand may be conferred on them. It is believed that the specific polyorganosiloxane used in step b) is responsible for the oleophobic effects attainable through plasma treatment and through treatment with RF polymers being not only not attenuated through treatment with polyorganosiloxane but being in fact distinctly amplified.

The production of fabrics which are in accordance with the present invention proceeds from textile fabrics consisting of polyolefin fibers to an extent in the range from 90% to 100% by weight. Preferably, they consist of polyolefin fibers to an extent of 100% by weight, but up to 10% by weight of other fibers can be present as well. The textile fabrics are nonwovens, but can also be, depending on the planned use, wovens.

Polypropylene fibers are preferred polyolefin fibers, but polyethylene fibers or blends of polypropylene fibers and polyethylene fibers can be used as well.

By choosing suitable process conditions under which steps a), b) and/or c) are carried out it is possible for the degree of the present invention's products' hydrophilicity/hydrophobicity and oleophobicity to be controlled and matched to the requirements which the final article has to meet. It is further possible for steps b) and c) to be carried out without use of an organic solvent, for example by application of the polyorganosiloxane in step b) and/or the polymer having perfluoroalkyl groups (RF) in step c) to the fiber material by spraying or in the form of a padding or foam operation from an aqueous medium. In the latter case, the fiber material after it has been subjected to steps b) and c), respectively, is additionally dried, for example at a temperature in the range of 80-120° C. for a period of a few seconds to 10 minutes depending on the drying unit used.

The good oil-repellent properties on the fiber materials are obtainable even when the fiber materials are dried in a relatively low temperature range, for example from 80 to 120° C. This is of significance for polyolefin materials, since these fibers may be damaged by temperatures above 130° C.

Polyolefin fiber fabrics according to the present invention can be produced using steps a), b) and c) mentioned above and in claim 1. All 3 steps are absolutely necessary to achieve the desired oil-repellent effects.

Step a) has to be carried out before steps b) and c). Step a) has to be followed by steps b) and c), either by first performing step b) and then step c), or by performing the steps b) and c) concurrently. This concurrent performance of steps b) and c) can be effected for example by treating the fiber material, after step a) has been carried out, with a mixture containing the polyorganosiloxane to be used in step b) and additionally the polymer with perfluoroalkyl groups (RF) which is to be used in step c). An example of a suitable mixture is a stable aqueous dispersion which is applied by means of a slop padding operation and which contains the specified polyorganosiloxane and the specified RF polymer with or without one or more dispersants.

Step b) can be carried out earlier than step c) or concurrently with step c). However, step c) must not take place earlier than step b).

When, after steps a) and b), step c) is carried out by treating only one surface of the textile fabric with the polymer containing perfluoroalkyl groups by spraying, for example, it is possible to produce articles which have very good oil-repellent properties on one surface only.

Step a) is a treatment of the textile polyolefin fiber fabric in a plasma. This plasma treatment has the purpose of activating the surface of the polyolefin fibers such that the subsequent treatments in steps b) and c) are operative in effecting good attachment of the polyorganosiloxane and the RF polymer to the fiber surface. This is why the plasma treatment has to be carried out such that, after step a) has been carried out, the textile fabric has a surface tension in the range from 35 to 60 mN/m and preferably in the range from 40 to 55 mN/m. These values are based on the test method of DIN 53 364 or ASTM D 2578-84.

Suitable process conditions and apparatuses for the plasma treatment are known to one skilled in the art. "AS Corona Star" apparatus from Ahlbrandt Systems, Germany, may be mentioned by way of example.

An ambient atmosphere medium will be found in practice to be particularly useful for the plasma treatment in step a) to produce polyolefin fiber materials which are in accordance with the present invention. An $He/O_2$ mixture can also be used as medium. If appropriate, the plasma treatment is carried out under reduced pressure, for example at a pressure in the range from 0.1 to 1 mbar. The plasma treatment creates polar sites on the fiber surface through the action of an electric field. Products can then subsequently be bonded to the fiber material at this polar surface.

Step b) of the process comprises a polyorganosiloxane treatment of the textile fabric obtained after step a). The polyorganosiloxane can be applied to the polyolefin fabric, by foam, spraying or by bath application for example, neat if it is liquid and its viscosity is in a suitable range. In other cases, it may be preferable to use the siloxane in diluted form, for example in the form of an aqueous solution or dispersion. Suitable dispersants are known to a person skilled in the art. They include customary nonionic surface-active products such as ethoxylated alcohols or ethoxylated amines. Aqueous polyorganosiloxane dispersions suitable for step b) are commercially available, an example being ULTRATEX FH neu from Ciba Spezialitätenchemie Pfersee GmbH. A further commercially available product which contains a polyorganosiloxane suitable for step b) is MAGNASOFT TLC from General Electric Silicones.

In the event that the abovementioned method is to be used, where steps b) and c) are carried out concurrently, a mixture containing the polysiloxane required for step b) and the polymer with perfluoroalkyl groups (RF polymer) required for step c) is used. This mixture may if appropriate contain just the two specified polymers in neat form. Customarily, however, the mixture additionally contains at least one diluent. Water is preferred for this purpose for environmental and cost reasons. So the mixture is preferably an aqueous solution or dispersion comprising the two polymers with or without one or more dispersants. Such mixtures are simple to produce by combining an aqueous solution or dispersion A with an aqueous solution or dispersion B, A comprising the polyorganosiloxane required for step b) and B comprising the RF polymer required for step c). The mixture may be applied advantageously to the textile polyolefin fiber fabric by foam application, spraying or by bath application, for example by a slop padding or nip padding operation.

The amount applied to the polyolefin fiber material of polyorganosiloxane in step b) and of polymer having perfluoroalkyl groups in step c) may vary within wide limits. In the individual case, the amounts depend on the degree of the oil-repellent properties to be achieved. A preferred range for the amount of polyorganosiloxane on the textile fabric after application and drying is between 0.1% and 4% by weight of polyorganosiloxane, based on the total weight of the fiber material after implementation of steps b) and c) and after drying.

Of decisive importance for the advantages to be achieved with the invention is the selection of the polyorganosiloxane used in step b). Of the group of the polyorganosiloxanes, only those are suitable which have units of the formula $$R_3Si—O—$$

as end groups of the polysiloxane chain. In the formula, all R radicals are independently methyl, ethyl or phenyl. Preferably, 80% to 100% of all R radicals present are methyl.

The polyorganosiloxanes used in step b) preferably have a linear construction; i.e., they preferably contain no silicon atoms in side chains.

To be suitable for step b), the polyorganosiloxanes must further contain units of the formula (I)

$$—Si(R)_2—O— \quad (I)$$

and units of the formula (II)

$$—Si(R)(X)—O— \quad (II)$$

within the polyorganosiloxane chain. In these formulae, all the R radicals are independently as defined above. Preferably 80% to 100% of all R radicals present are methyl. All the X radicals present represent a radical of the formula (III)

$$—(CH_2)_t—(O—CHR^1—CHR^2)_z—OR^3 \quad (III)$$

where t is from 1 to 4 and z is from 5 to 60. In every unit of the formula $$—O—CHR^1—CHR^2—$$

one of $R^1$ and $R^2$ is hydrogen and the other is hydrogen or a methyl group. Every $R^3$ radical present is H or an R radical of the abovementioned kind. Preferably, 50% to 100% of all $R^3$ radicals present are hydrogen.

Preferably, in at least 50% of all units of the formula $$—O—CHR^1—CHR^2—$$

present, not only the $R^1$ radicals but also the $R^2$ radicals are hydrogen. It is even more advantageous when in 80% to 100% of these units both the $R^1$ and $R^2$ radicals are hydrogen. Polyorganosiloxanes comprising polyoxyethylene radicals only and no polyoxypropylene radicals are particularly suitable.

Polyorganosiloxanes useful in step b) can be used, as stated above, either neat or combined with a diluent. A particularly preferred diluent is water with or without one or more dispersants, so that step b) preferably utilizes aqueous dispersions of suitable polysiloxanes.

Polyorganosiloxanes useful in step b) or aqueous dispersions of such polysiloxanes are commercially available and can be produced by processes known to one skilled in the art.

For instance, the JP-A 2004/156 163 reference mentioned at the beginning describes suitable products and their production. Commercially available products are "Dow Corning (DC) 193 surfactant"; "ULTRATEX FH neu" (Ciba Spezialitätenchemie Pfersee GmbH) and the above-mentioned MAGNASOFT TLC are aqueous silicone dispersions suitable for step b).

Liquid polyorganosiloxanes having a viscosity of 200 to 800 cSt at 25° C. are very useful for performing step b). The stated viscosity relates to the neat polysiloxane.

Polyorganosiloxanes forming a clear solution in water will prove very particularly useful for step b).

Step b) preferably utilizes polyorganosiloxanes of the following formula (IV) or aqueous dispersions of such polyorganosiloxanes:

$$(CH_3)_3Si—O—[Si(CH_3)_2—O]_m[Si(CH_3)(X)—O]_p—Si(CH_3)_3 \quad (IV)$$

where the individual $—Si(CH_3)_2—O—$ and $—Si(CH_3)(X)—O—$ units may be randomly distributed throughout the polysiloxane chain and where m is from 15 to 25 and p is from 3 to 10.

Step c), which as mentioned can be carried out concurrently with step b) or later than step b), comprises treating the textile polyolefin fiber fabric with a polymer containing perfluoroalkyl groups (RF groups). This polymer is a polyacrylic polymer or a polyurethane. Mixtures of these two polymers can also be used. Useful polyacrylic polymers include poly (meth)acrylate esters having RF groups in the alcohol component. They are obtainable by esterification of (meth)acrylic acid or derivatives thereof with alcohols containing RF groups and subsequent polymerization or appropriate esterification of poly(meth)acrylic acid or its derivatives. RF-containing polyurethanes are obtainable by polyaddition of polyfunctional isocyanates with RF-containing diols or polyols.

In the process leading to products which are in accordance with the present invention, step c) comprises applying either a polyacrylic polymer or a polyurethane to the fiber materials consisting of polyolefin fibers to an extent of 80-100% by weight. The polymer used comprises perfluoroalkyl groups and, when it is a polyurethane, is obtainable by reaction of a polyfunctional isocyanate or of a mixture of such isocyanates with a polyfunctional alcohol comprising one or more perfluoroalkyl groups of the formula (V)

$$CF_3—(CF_2)_a— \quad (V)$$

or with a mixture of such alcohols. Preference is given to using difunctional isocyanates, i.e., compounds having two —NCO groups, and dihydric alcohols, i.e., diols, for the reaction. In the abovementioned formula (I), a is from 3 to 23 and preferably from 5 to 15.

The polyurethanes obtained in the reaction mentioned comprise a plurality of repeat units of the formula $$—NH—\overset{O}{\overset{\|}{C}}—O—R^4—O—\overset{O}{\overset{\|}{C}}—NH—R^5—$$

where $R^4$ and $R^5$ are those polyfunctional organic radicals derived from the polyfunctional isocyanates $R^5(NCO)_2$ and alcohols $R^4(OH)_2$ used, each $R^4$ radical comprising one or more RF groups. Preferably, $R^4$ and $R^5$ are difunctional radicals without any further NCO and OH groups respectively; i.e., it is preferable to use difunctional isocyanates and dihydric alcohols.

The reaction of the polyfunctional isocyanates with the polyhydric alcohols is preferably carried out using such molar ratios that the polyurethane formed contains free isocyanate groups not at all or only in insignificant amounts, i.e., in an amount of less than 5% based on the NCO groups present before the reaction.

The reaction of the polyfunctional isocyanates with the polyhydric alcohols can be carried out according to methods known from urethane chemistry. Such methods are described for example in U.S. Pat. No. 3,968,066, U.S. Pat. No. 4,054,592 and U.S. Pat. No. 4,898,981. This reaction preferably takes place in an organic solvent, for example in a dialkyl ketone, and with the use of a catalyst or of a mixture of catalysts. Useful catalysts include trialkylamines and metal compounds such as tetraalkyl titanate.

Furthermore, RF-containing polyurethanes, which are formed in the reaction described, are commercially available, for example from Du Pont, USA or Clariant, Germany. Aqueous dispersions of RF-containing polyurethanes are available under the name of PHOBOTEX® 7808 or 7811 from Ciba Spezialitätenchemie Pfersee GmbH.

A particularly suitable polyurethane for step c) is obtainable by reaction of an aliphatic diisocyanate or of a mixture of aliphatic diisocyanates with a diol of the formula (VI) or of the formula (VII)

$$C(—CH_2OH)_2(—CH_2—S—CH_2CH_2—RF)_2 \quad (VI)$$

$$[RF—CH_2—CH(OH)—CH_2—]_2S \quad (VII)$$

where RF is a radical of the above-indicated formula (V) where a is a number from 5-19,
or with a mixture of such diols.

The application of the perfluoroalkyl-containing polyurethane to the polyolefin fiber material can be carried out according to methods customary in textile finishing, for example via a nip padding or roller application process. Application via a nip padding process with subsequent drying of the fiber material is preferred. The polyurethane is preferably applied to the fiber material, via a nip padding process for example, in the form of an aqueous dispersion. This dispersion may contain the polyurethane in a concentration customary for nip padding processes, for example in the range from 0.05% to 50.0% by weight. Depending on conditions of application, the RF polymer content on the final article can be in such a range that the article has a fluorine content in the range from 0.01% to 2.0% by weight.

The polyurethane-containing aqueous dispersions normally additionally contain one or more surface-active products as dispersants. Preference is given to using one or more nonionic or cationic dispersants or a mixture of one or more cationic dispersants and one or more nonionic dispersants. In individual cases, it is also possible to use anionic dispersants or a mixture of an anionic dispersant and a nonionic dispersant. The amount of dispersant or dispersant mixture can be in the customary, known range, for example in the range from 1% to 10% by weight, based on the total amount of dispersion.

Useful cationic dispersants include known quaternary ammonium salts, while known ethoxylated longer-chain alcohols are useful as nonionic dispersants.

The aqueous dispersions of the polyurethanes can be prepared according to generally known methods, for example by dissolving one or more dispersants in water, adding the polyurethane and effecting mechanical homogenization. The polyurethane can be added to the aqueous solution in pure form or as a solution or dispersion in an organic solvent. In the latter case, the organic solvent is removed, conveniently by distillation, after the aqueous dispersion has been homogenized. Useful organic solvents include dialkyl ketones.

Extenders may be applied to the fiber materials, if appropriate, together with the RF-containing polyurethanes. Useful extenders include prior art products known from the prior art, for example compounds having isocyanate groups blocked by oximes. Such extenders are capable of amplifying the soil- and water-repellent properties of the fiber materials. However, extenders having oxime-blocked isocyanate groups have to be exposed to comparatively high temperatures, frequently temperatures above 130° C., to become deblocked and hence active. For this reason, the additional use of extenders in the process leading to the products which are in accordance with the present invention is limited to cases where the fibers are not damaged by the temperatures required for deblocking.

In lieu of or in addition to the above-described group of RF-containing polyurethanes, polyacrylic polymers containing perfluoroalkyl groups (RF groups) can also be used in step c). It has been determined that, in a number of cases, RF-containing polyacrylic polymers lead to even better results than the RF-containing polyurethanes mentioned.

RF-containing polyacrylates, aqueous dispersions thereof and also their production are known to one skilled in the art. Suitable products are described in US 2004/0075074 A1 and US 2004/0147665 A1.

Furthermore, acrylic polymers useful for step c) and aqueous dispersions thereof are commercially available.

Polyacrylic polymers having perfluoroalkyl groups (RF groups) are preferably esters of polyacrylic or polymethacrylic acid which have RF groups in the unit derived from the alcohol. These polymers preferably comprise products comprising the structural repeat unit $$—CH_2—C(T)[COO(CH_2)_w—RF]—$$

where T is H or $CH_3$, w is from 2 to 6 and RF is a radical of the abovementioned formula (V). Such acrylate polymers are obtainable by esterification or transesterification of poly (meth)acrylic acids or their derivatives with RF-containing alcohols.

The present invention's fabrics composed of polyolefin fibers have markedly oleophobic/oil-repellent properties. Their oleophobic/hydrophilic properties can be characterized by the following test methods:

1. Oil repellency in accordance with AATCC 118-1997 or DIN-ISO 14419.

The oleophobic properties of fabrics are determined and rated on a scale from 0 to 8, where 8 indicates the strongest oil-repellent effect.

2. Water drop test based on AATCC TM 193

The repellent effect of a fabric with regard to mixtures of water and isopropanol in different mixing ratios is determined and rated on a scale from 0 to 14. This method provides information as to the repellent effect with regard to low molecular weight alcohols, which is important for use in the medical sector. A rating of 14 indicates the strongest repellent effect.

The invention will now be illustrated by operative examples.

EXAMPLE 1

Inventive

A 3-ply spunbond-meltblown-spunbond (SMS) nonwoven in 100% by weight of polypropylene and having a basis weight of 35 g/m$^2$ was (process step a)) treated with plasma of ambient atmosphere.

Conditions:

The speed with which the nonwoven was led through the apparatus was 10 m/min. The residence time amounted to fractions of seconds, the power rating of the apparatus was 600 W and the electrode length was 40 cm (Ahlbrandt AS Corona Star as apparatus).

Subsequently, in accordance with steps b) and c), an aqueous dispersion was applied to the nonwoven by means of a nip padding process. The dispersion contained 50 g/l of a polyorganosiloxane (ULTRATEX FH neu) and 100 g/l of a polyacrylate, i.e., of a polyacrylic ester containing perfluoroalkyl groups in the alcohol component. The wet pickup was 20% by weight, based on the weight of the nonwoven before application of the aqueous dispersion. Subsequently, the nonwoven was dried at 120° C. for 1 minute.

EXAMPLE 2

Non-Inventive, Comparative Example

Example 1 was repeated except that the aqueous dispersion only contained 100 g of the polyacrylate with RF groups, but no polysiloxane, i.e., only steps a) and c) were carried out, but not step b).

EXAMPLE 3

Non-Inventive, Comparative Example

Example 2 was repeated without preceding plasma treatment, i.e., only step c) was carried out and no steps a) and b).

The nonwovens of Examples 1 to 3 were tested by means of the abovementioned methods to determine the oil repellency to AATCC 118-1997 and the repellent effect with regard to water/isopropanol in the water drop test.

Table 1 shows the results.

TABLE 1

| Example | Oil repellency rating | Water drop rating |
|---|---|---|
| 1 | 5 | 10 |
| 2 | 3 | 10 |
| 3 | 1 | 10 |

It is clear to see that the inventive example (#1) gives the highest values of oil repellency.

EXAMPLE 4

Inventive

A polypropylene nonwoven was treated with plasma as in Example 1. Next, an aqueous dispersion was applied to the nonwoven by spraying. The dispersion contained 100 g/l of ULTRATEX FH neu and 500 g/l of an RF-containing polyurethane (PHOBOTEX 7811). The add-on after drying (5 minutes/120° C.) corresponded to a weight increase of 30%.

EXAMPLES 5 AND 6

Non-Inventive, Comparative Examples

Example 4 was repeated twice, in one case (=Example 5) without the aqueous dispersion containing any polysiloxane and in the second case (=Example 6) without a plasma treatment being performed and the aqueous dispersion containing any polysiloxane.

Determination of the properties using the methods mentioned in Examples 1 to 3 resulted in the values reported in Table 2.

TABLE 2

| Example | Oil repellency rating | Water drop rating |
|---|---|---|
| 4 | 5 | 10 |
| 5 | 3 | 10 |
| 6 | 0 | 10 |

Of these Examples 4 to 6, it is again the case that the inventive example (#4) is superior to the comparative examples (#5 and 6).

What is claimed is:

1. A fabric composed of polyolefin fiber, obtainable by a process comprising the following steps a) to c) of a) treating an untreated textile fabric consisting of polyolefin fiber to an extent in the range from 90% to 100% by weight in a plasma under such conditions that, after step a) has been carried out, the fabric has a surface tension in the range from 35 to 60 mN/m, b) treating the fabric obtained after step a) with a polyorganosiloxane containing $R_3Si—O—$ units as end groups and, within the polyorganosiloxane chain, units of the formula (I)

$$—Si(R)_2—O— \quad (I)$$

and units of the formula (II)

$$—Si(R)(X)—O— \quad (II)$$

where each R is independently $CH_3$, $CH_2—CH_3$ or phenyl, and each X is a radical of the formula (III)

$$—(CH_2)_t(O—CHR^1—CHR^2)_z—OR^3 \quad (III)$$

where t is from 1 to 4, z is from 5 to 60, in each unit of the formula $$—O—CHR^1—CHR^2—$$

one of $R^1$ and $R^2$ is H and the other is H or $CH_3$ and every $R^3$ present is H or is R, c) treating the fabric with a polymer containing perfluoroalkyl (RF) groups, this polymer being a polyacrylic polymer having RF groups or a polyurethane having RF groups or a mixture of such polymers, this step c) being carried out concurrently with step b) or later than step b).

2. The fabric of claim 1, characterized in that it consists of polypropylene fiber to an extent of 100% by weight.

3. The fabric according to claim 1, characterized in that it is a nonwoven.

4. The fabric of claim 1, characterized in that the plasma treatment of step a) is carried out in an ambient atmosphere medium.

5. The fabric of claim 1, characterized in that step b) utilizes a polyorganosiloxane of the formula (IV)

$$(CH_3)_3Si—O—[Si(CH_3)_2—O]_m—[Si(CH_3)(X)—O]_p—Si(CH_3)_3 \quad (IV)$$

where the individual $—Si(CH_3)_2—O—$ and $—Si(CH_3)(X)—O—$ units may be randomly distributed throughout the polysiloxane chain, m is from 15 to 25 and p is from 3 to 10.

* * * * *